US005402724A

United States Patent [19]

Yaeso et al.

[11] Patent Number: 5,402,724

[45] Date of Patent: Apr. 4, 1995

[54] METHOD AND APPARATUS FOR WASHING THE DECK OF A PRESS OR COATER

[75] Inventors: Felix R. Yaeso, Green Bay; Dale E. Zeman, Denmark, both of Wis.

[73] Assignee: Paper Converting Machine Company, Green Bay, Wis.

[21] Appl. No.: 274,999

[22] Filed: Jul. 13, 1994

Related U.S. Application Data

[63] Continuation-in-part of Ser. No. 145,460, Oct. 29, 1993, abandoned.

[51] Int. Cl.[6] ..... B41F 35/06

[52] U.S. Cl. ..... 101/424; 101/425

[58] Field of Search ..... 101/424, 423, 425

[56] References Cited

U.S. PATENT DOCUMENTS 4,686,902 8/1987 Allain ..... 101/424
4,774,884 10/1988 Sugimoto et al. ..... 101/170
5,109,770 5/1992 Uribe et al. ..... 101/425
5,213,044 5/1993 Elia et al. ..... 101/483

FOREIGN PATENT DOCUMENTS 64-253788 9/1989 Japan .
2068835 8/1981 United Kingdom .

*Primary Examiner*—Edgar S. Burr
*Assistant Examiner*—Anthony H. Nguyen
*Attorney, Agent, or Firm*—Tilton, Fallon, Lungmus & Chestnut

[57] ABSTRACT

A method and apparatus for washing the fountain of a flexographic press including a positive displacement pump coupled to the ink fountain of the press and selectively to solvent and waste containers to a closed circuit for recycling and to atmosphere for purging and, optionally, to a solvent saver receiver.

15 Claims, 10 Drawing Sheets

FIG. 8
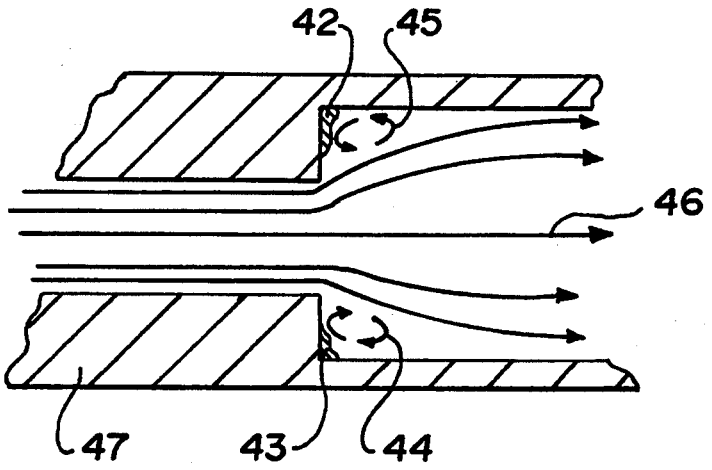
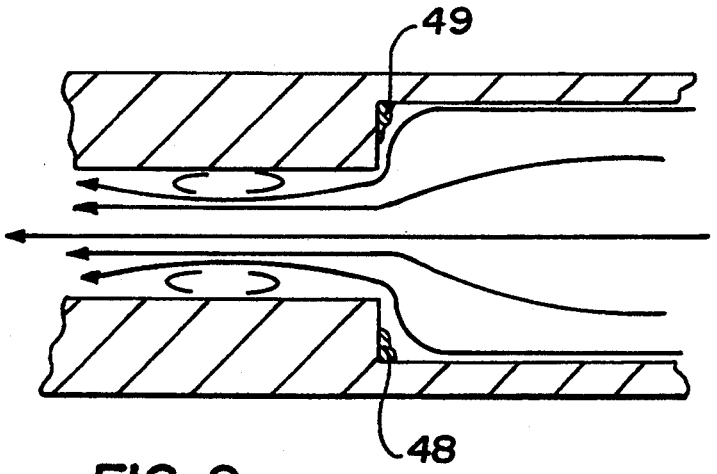
FIG. 9

METHOD AND APPARATUS FOR WASHING THE DECK OF A PRESS OR COATER

This is a continuation-in-part of application Ser. No. 08/145,460, filed Oct. 29, 1993, now abandoned.

BACKGROUND AND SUMMARY OF INVENTION

This invention relates to a method and apparatus for washing the deck of a press or coater and, more particularly to one having an enclosed doctor blade chamber for metering the solution onto a roll such as a flexographic anilox roll or a gravure roll. For convenience, the ensuing description will be in terms of a flexographic press.

The wash-up of a deck (the fountain and anilox roll) of a flexographic press has been time-consuming and costly. Whenever the ink is changed (for color, consistency, etc.), the old ink must be removed and this is a chore that no one likes. Wash-up has been considered to be the biggest part of a job changeover.

In the past, it has been necessary to circulate up to 20 gallons of solvent to completely clean a deck. The solvent flows through the fountain chamber, being confined by the rotating anilox roll which also requires cleaning. During wash-up, the solids content in the solvent rises to quickly reach an equilibrium so large volumes of solvent have been necessary.

A further complication lies in the fact that to get the job done efficiently, high flow rates are employed, particularly for creating turbulent flow so as to thoroughly cleanse the chamber. However, the end seals normally employed are capable of withstanding only slight pressure, i.e., of the order of 10 to 15" $H_2O$. A higher flow rate can cause leakage past the end seals. Therefore, the wash-up job has taken longer than desired.

According to the invention, fresh or once used solvent is drawn into the valve-equipped system while the remaining ink or waste solvent is being pumped into the waste receiver. Once the system has been so charged, valves shift allowing the pump to circulate the solvent through a closed circuit or loop which allows the highly desirable higher flow rates. Also, the pump rotation can be repetitively cycled between forward and reverse directions to enhance the cleaning action of the solvent. The solvent may be any fluid used to dilute the ink components and carry away the ink solids—for example, water for a water-based ink.

The system then may be recharged with fresh solvent where once used solvent has been employed. Thereafter the system is drained of solvent which is replaced by air. In this way nearly all components of the inking system (hoses, pump, anilox roll, doctor blade chamber, valves, fittings, etc.) are automatically cleaned and made ready for the next printing job.

In a preferred embodiment of the invention, it is advantageous to use a solvent saver, i.e., an addition to the system to first circulate once used solvent for a preliminary cleaning of the system. This results in a material reduction of solvent required—from about two gallons per deck to about one gallon.

In this preferred embodiment a fifth valve is employed along with an additional receiver over the basic system. This receiver advantageous has a volume approximately equal to the volume of the system, i.e., volume in the hoses, pump, chamber and valves. Three passages lead from the additional receiver, two return lines and one suction line. The discharge ends of the return lines are positioned above the expected solvent level in the additional receiver whereas the suction line end draws from near the bottom.

In operation, once printing is completed, the system valving is adjusted so as to direct once used solvent from the additional receiver into the system while directing the remaining ink into the waste receiver. Thereafter, the system is closed off to recirculate the once used solvent, thereby scouring the system and converting this heretofore once used solvent to waste solvent. After cycling, the now waste solvent is directed to the waste receiver while fresh solvent is pumped into the system. Prior to introducing ink for a further operation, the new batch of once used solvent is directed into the additional receiver in two stages. A first portion of the system is drained into the additional receiver, the once used solvent being replaced by air from the top of the additional receiver, the second or reverse draining directs the remainder of the once used solvent into the additional receiver while also replacing it with air.

The prior art can be illustrated by U.S. Pat. No. 5,213,044 which has to do with an offset litho press—not a flexographic press. In the lithographic press, there is not a closed ink chamber which precludes washing through repetitive cycles. All that can be done in the litho press is to fill the ink chamber with solvent and drain the same because any attempt to pump solvent through the chamber would result in overflow and loss.

Other objects and advantages of the invention may be seen in the details of the ensuing specification.

BRIEF DESCRIPTION OF DRAWING

The invention is explained in conjunction with the accompanying drawing in which

FIG. 8 is a fragmentary sectional view of a portion of connecting piping illustrating fluid flow at a sudden enlargement;

FIG. 9 is a view similar to FIG. 8 but illustrating flow at a sudden contraction.

Figure 1:
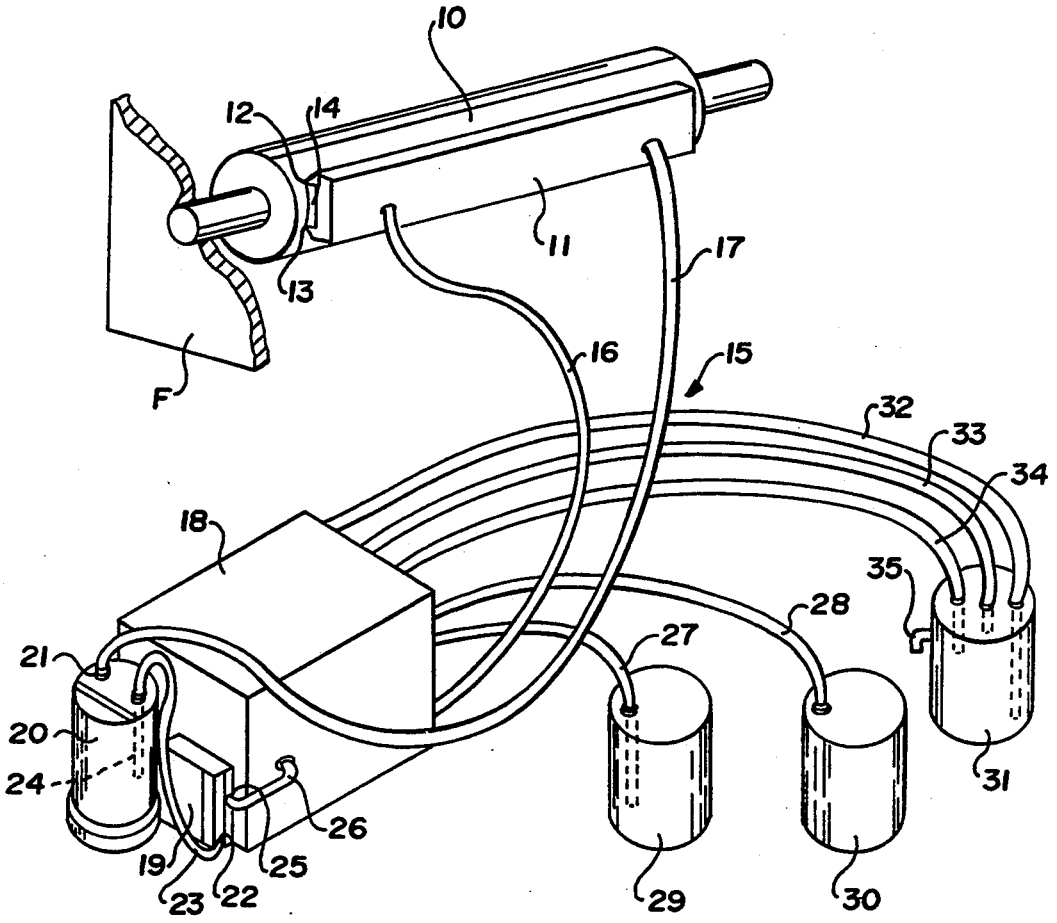
FIG. 1 is a perspective essentially schematic representation of a flexographic press employed in the practice of the invention.

DETAILED DESCRIPTION:

In the illustration given and with reference first to the left portion of FIG. 1 the symbol F refers to the press frame. The numeral 10 designates generally an anilox roll rotatably mounted on the frame F. Associated with the anilox roll 10 is an ink fountain 11 equipped with doctor blades 12 and 13 along with suitable end seals, one of which is shown at 14. The fountain 11 is also mounted on the frame F and with the anilox roll 10 forms an ink chamber with a pair of ports for introducing and removing fluid. This much of the system is conventional and may take a variety of forms. Omitted for the sake of ease of presentation and clarity are the remaining press elements, viz., frame, central impression cylinder, plate cylinder, etc.

As indicated previously, the invention is used advantageously with the fluid system associated with the flexographic press and this is generally designated 15. The system 15 provides a first conduit 16 which is connected near the lower part of the fountain 11 and a second conduit 17 connected near the upper part of the fountain 11. During printing (as will be explained in connection with FIG. 2), the conduit 16 delivers ink to the fountain and the conduit 17 returns excess ink.

Still referring to FIG. 1, the numeral 18 designates a cabinet operably associated with the frame F and which houses the valves, air cylinders and pump motor. In the illustration given it also supports the pump 19 and the ink pail 20. A suitable pump is Model No. 750-000 from Randolph Pump Co. located at Mancheca, Tex. 78652. The return conduit 17 is connected to the pail 20 at 21 and the pump 19 has one port 22 coupled via conduit 23 to the pail 20 as at 24. The second port 25 of pump 19 is connected via conduit 26 to the interior of the housing 18, viz., to valves to be described hereinafter. These valves are also connected to the line 16.

The housing 18 also has its valving connected via conduits 27 and 28 to container 29 and receiver 30 for fresh and waste solvent respectively. The housing 18 also is connected to once used solvent receiver or reservoir 31 by supply line 32 and return lines 33 and 34. The additional receiver 31 also has an air vent 35 for intake and exhaust of air.

Now referring to FIG. 2, the function of the foregoing elements in "inking" will be described.

INKING

Figure 2:
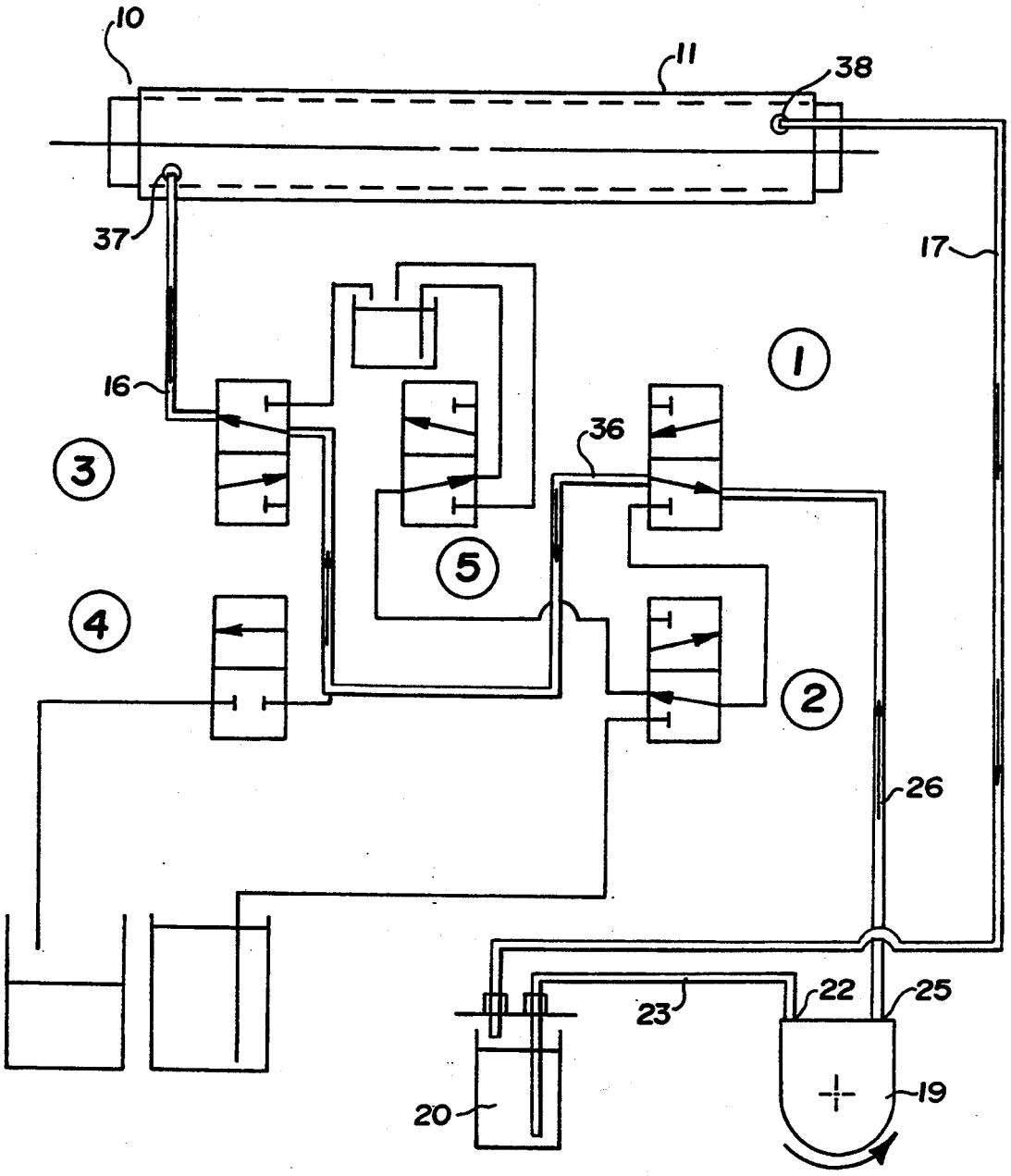
FIG. 2 is a schematic view showing the condition of the hydraulic circuit as it would be arranged for normal printing.

Generally, FIG. 2 illustrates the inking circuit. This shows the position of the valves and direction of pump rotation for normal printing. Ink is supplied to the doctor blade chamber and returns to the ink pail by gravity.

More particularly, ink from the pail 20 is drawn through conduit 23 to the port 22 of the pump 19. The ink is forced out of the port 25 into the conduit 26 where it is delivered to a three-way valve 1.

After passing through one passage of the valve 1, the ink flows via conduit 36 and, unlike in our earlier invention, by-passes the second three-way valve 2. Instead, it flows via conduit 36 and through one passage of a third three-way valve 3. The output of valve 3 (as shown in FIG. 2) flows via conduit 16 to the lower port 37 of the ink fountain 11. Meanwhile, excess ink can flow out of the upper port 38 of the fountain 11 and via conduit 17 to the ink pail 20. The valves except 4 are advantageously ball valves of Model 70-000/900 Series of Conbraco Industries of Pageland, South Carolina and are equipped with air cylinders for rotating the balls thereof. For cleanup there has to be a change in the connection between the pump and ink pail to the pump and once-used solvent reservoir. This is illustrated relative to FIG. 3 in connection with the charging of once used solvent.

ONCE USED SOLVENT CHARGE

Figure 3:
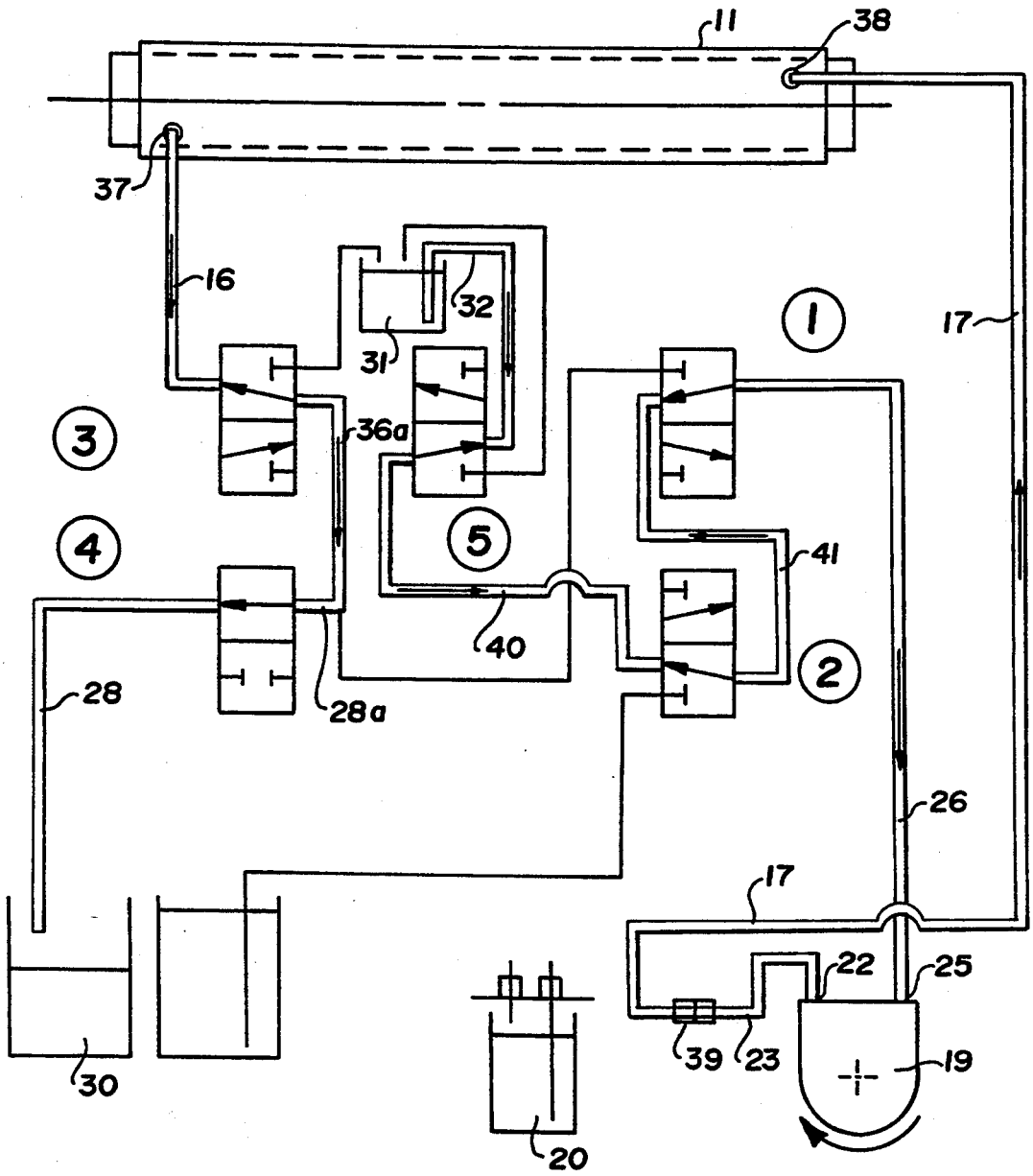
FIG. 3 is a view similar to FIG. 2 but showing the hydraulic system in the condition for charging with solvent from the solvent saver receiver.

FIG. 3 has to do with charging of solvent and it generally involves the press operator disconnecting the conduits 17 and 23 from the ink pail 20 and connecting them together as at 39—see the lower portion of FIG. 3. Alternatively, this can be achieved by suitable valving. All five of the valves are now employed—in the condition represented in FIG. 3. This enables once used solvent—from a previous cycle but relatively fresh—to be pumped into the upper port 38 of the chamber to displace the ink remaining in the chamber 11 and line 16 and direct this unwanted ink to the waste receiver 30.

Valves 1 and 4 are shifted from their first condition as shown in FIG. 2 so that when the pump 19 is operated in the reverse direction (see the arrow under the pump 19), once used solvent from the receiver 31 is drawn into the valves, hoses and doctor blade chamber. The pump 19 is rotated for a predetermined number of revolutions corresponding to the volume of the system and then stopped. Any excess volume of ink will be pumped directly into the waste receiver 30.

More particularly, the once used solvent is drawn from the receiver 31 into conduit 32, through the one passage of valve 5, and a previously selected passage of valve 2 through the other passage of valve 1 and then via conduit 26 into port 25 of pump 19. The reverse rotation of the pump 19 delivers this once used solvent out of port 22 and through lines 23 and 17 into the upper port 38 of fountain 11.

By virtue of rotating the ball in valve 4, the ink from chamber 11 exits through lower port 37, conduit 16 through the same passage as before in valve 3 through a portion **36*a* of conduit 36. From there the ink passes through branch line 38*a*, through the now open valve 4 and conduit 28 into the waste receiver 30. Valve 4** is a two-way valve of Model 70-100/200 Series of the above Conbraco Industries.

Figure 4:
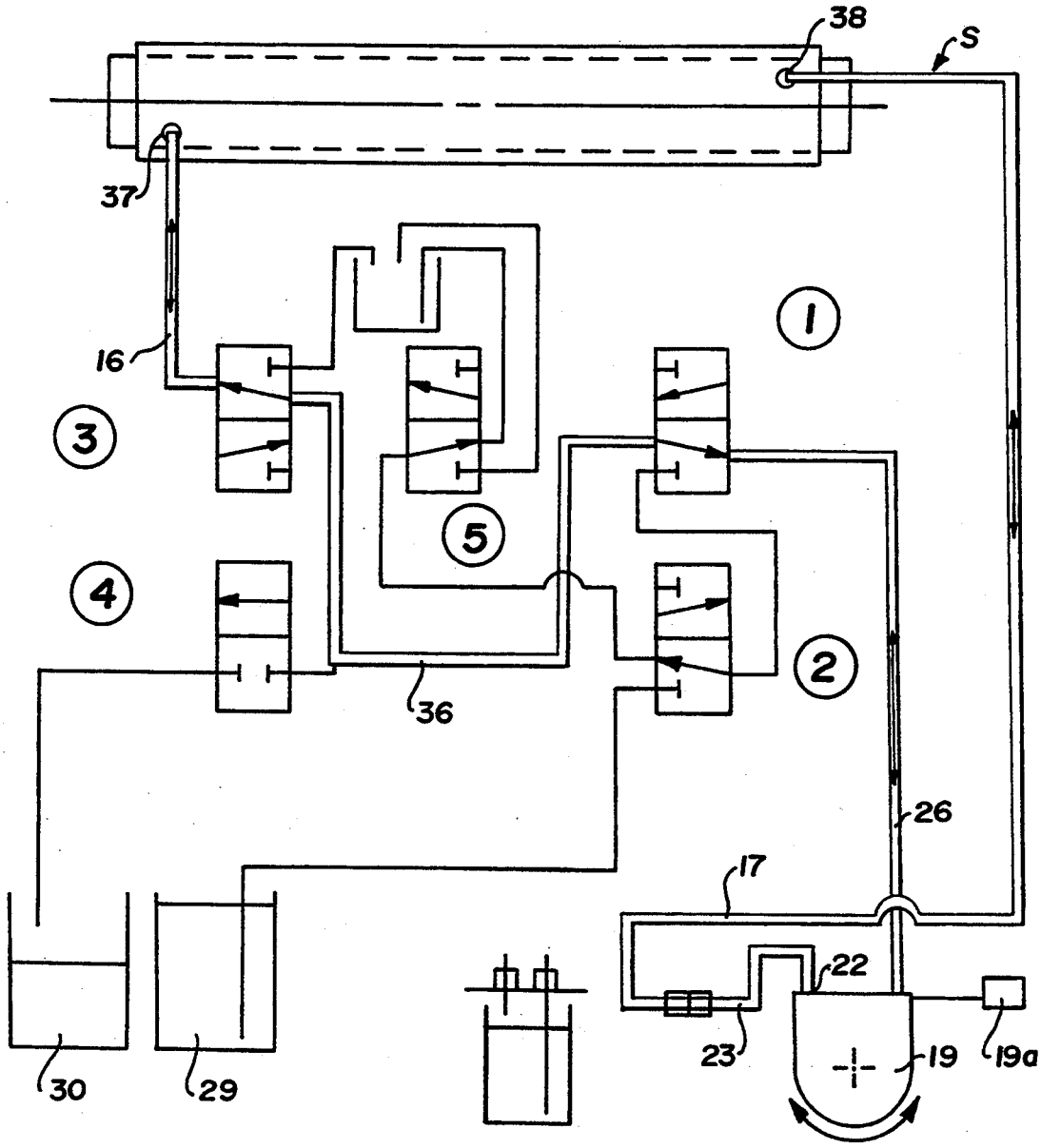
FIG. 4 is a view similar to FIGS. 2 and 3 but showing the wash cycle.

Now that the hydraulic system 15 is filled with once used solvent, the washing cycle can commence and this is described in conjunction with FIG. 4.

WASH CYCLE

Figure 5:
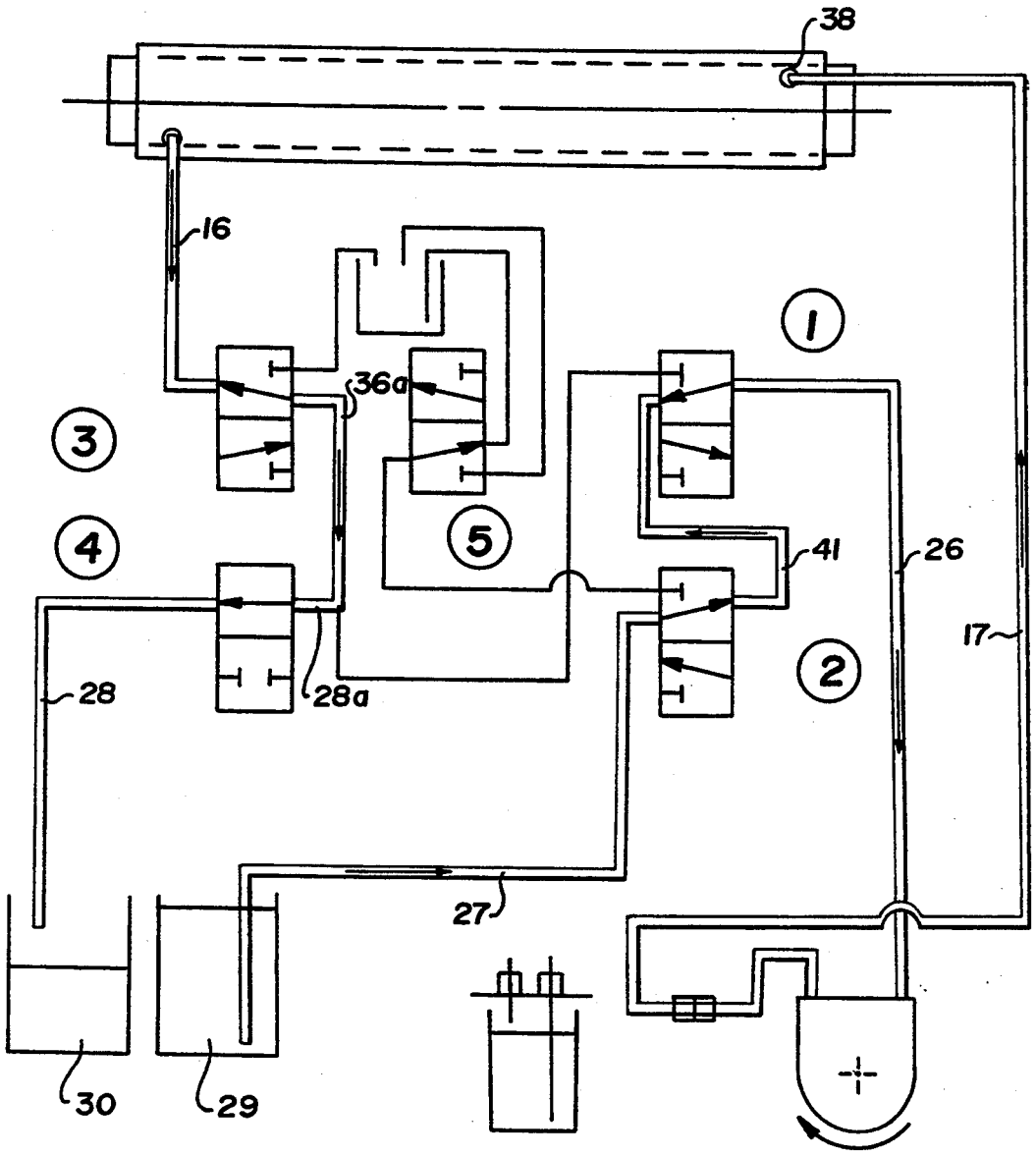
FIG. 5 is a view similar to FIGS. 2–4 but showing the hydraulic system in the condition for charging with fresh solvent.

In summary, valves 1 and 4 are returned to their original state of inking (see FIG. 2) while the other three valves remain in their FIG. 5 condition. Now a pump 19 is rotated in alternating forward and reverse directions for washing—see the extreme lower right hand portion of FIG. 4. The rotational arrow is double ended to indicate this alternation. This can be done either manually or automatically by control means such as a Model PIC-90 motion controller made by Giddings & Lewis of Fond du Lac, Wis.

Preferably, the means **19*a* for controlling the pump provides a rotation at maximum flow rate to increase the turbulence in the hoses, valves and doctor blade chamber. Advantageously, this rate is up to five times the normal ink flow rate and preferably three times. After several flow reversals, the system is typically recharged as shown in FIG. 5 and the wash cycle FIG. 4** is repeated to provide a level of desired cleanliness (typically two wash cycles are adequate to allow changing to a new color ink).

More particularly, the rotation of the balls in the valves 2 and 4 brings the hydraulic system 15 almost back into its configuration for inking—see FIG. 2. The exception to complete identity is the fact that the lines 23 and 17 are now coupled together as they were in FIG. 3—but not in FIG. 2. Thus, the port 22 is coupled through these lines and instead of being connected to the ink pail 20.

The closed circuit connects the ink pail lines 23 and 17 together allows flow rates which are much higher than are possible with the typical inking circuit. Flow rates are typically limited due to pressure limitations on a doctor blade chamber end seals, viz., the seal 14 of the upper left hand portion of FIG. 1. Because the closed circuit pulls the solvent out of the doctor blade chamber 11 at the same time that it pushes the solvent in, the pressure inside of the chamber stays very close to atmospheric and does not leak.

After the last wash cycle is complete, we arrange for charging of fresh solvent from the fresh solvent source 29 and this is discussed in connection with FIG. 5.

CHARGE OF FRESH SOLVENT

This is similar to the step in our prior application except that now the liquid directed to the waste receptacle 30 is "twice used" solvent, not ink (also as in FIG. 3 here). The fresh solvent is removed from the source receptacle 29, flowing through line 27 to valve 2 . Thereafter the path of fresh solvent is the same as in FIG. 3 relative to once used solvent. Both solvents flow through line 41 to valve 1 then via line 26 to pump 19 where it is directed to port 38 via line 17.

The "twice used" solvent exits the chamber 11 via port 37 and in both instances flows through line 16, valve 3 , line 36*a*, line 28*a*, valve 4 and line 28 to waste receptacle 30. What is left in the system now is fresh solvent which is then used in a wash cycle as described in FIG. 6. After washing, this solvent will be directed to the additional receiver 31 in two convenient stages—particularly when the chamber 11 is elevated so as to permit gravity draining. This is explained in conjunction with FIGS. 6 and 7.

CHAMBER AND SUPPLY LINE DRAIN

Figure 6:
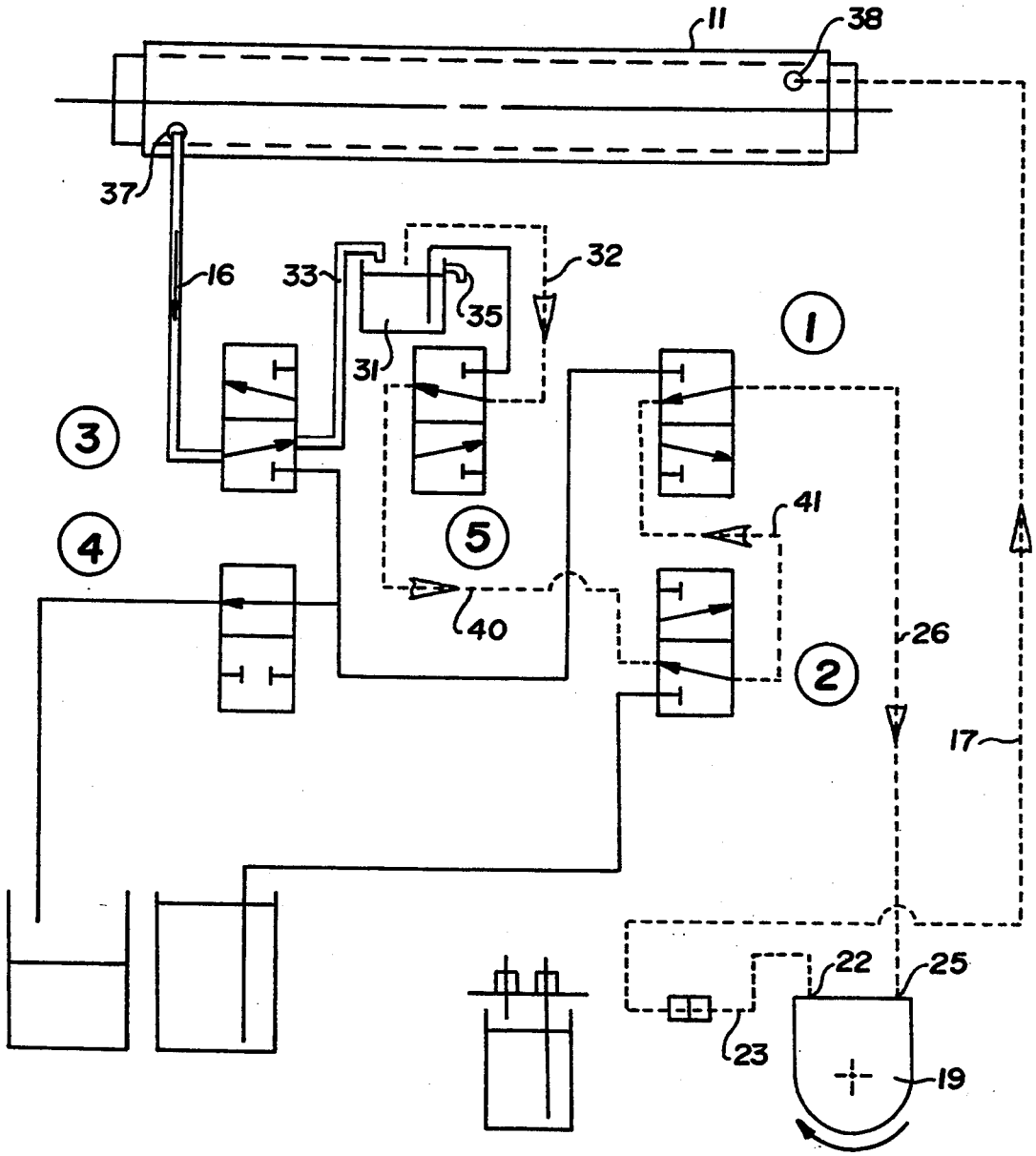
FIG. 6 is another schematic view like FIGS. 2–5 but showing the draining of the doctor and supply line to the solvent saver receiver.

Referring now to FIG. 6, it will be seen that valve 3 has been changed from its FIG. 5 condition. Now, the pump 19 is run in reverse—compare FIG. 2. This draws air into the system from air port 35 and directs the once used solvent in the system into the receiver 31. The air flow is indicated by dotted lines.

More particularly, valve 5 is connected to the air port 35 in receiver 31 via line 32 and via lines 40, 41 and valves 1 and 2 are connected to conduit 26 connected to port 25 of pump 19. The output of pump 19 (in this orientation) is through port 22, lines 23 and 17 into the upper port 38 of the chamber 11. Concurrently, once used solvent flows out of the chamber 11 via port 37 into a conduit 16, valve 3, conduit 33, and receiver 31.

PUMP AND RETURN LINE DRAIN

Figure 7:
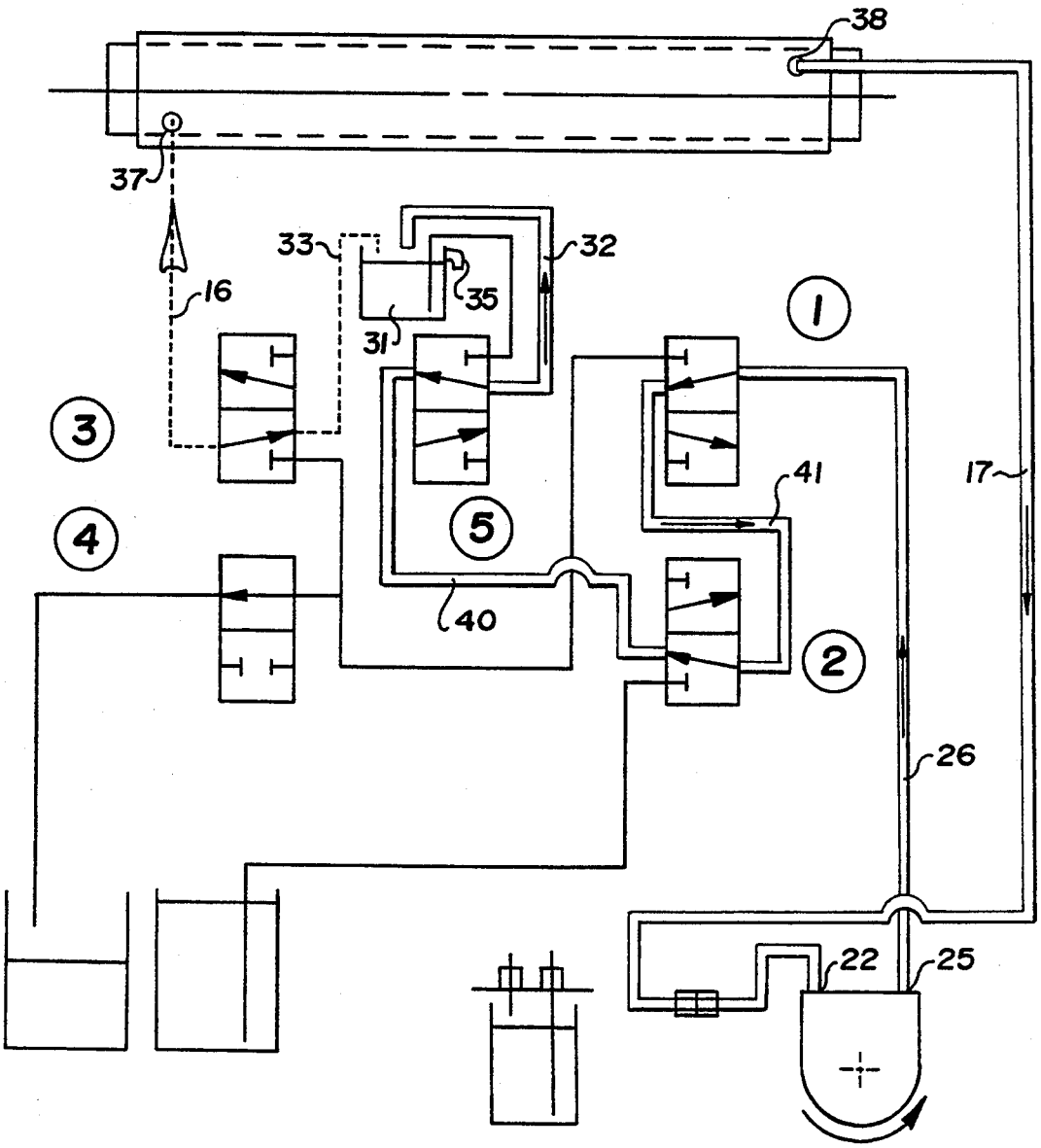
FIG. 7 is yet another schematic view (like FIGS. 2–4) but showing return line and pump drain to the solvent saver receiver.

This is illustrated in connection with FIG. 7 which is almost identical to FIG. 6 but with the exception that the pump is now rotated in the forward direction so as to introduce air into the bottom port 37 of fountain 11 rather than the top port 38.

So air is drawn into the system at 35 (upper left) and flows through conduit 33. The air then goes through valve 3 and conduit 16 into port 37. After flushing any once used solvent out of the fountain 11, the air (now mixed with this solvent) exits through port 38 and line 17 to the port 22 of pump 19. The mixture leaves through pump port 25, line 26 and valves 1 , 2 and 5 to conduit 32 and into receiver 31.

Because certain parts of the hose routings contain traps, i.e., low areas which do not pump dry, the second drain cycle is performed with the pump 19 running in the forward direction. In this way, nearly all of the solvent can be pumped out of the system prior to introducing the next batch of ink.

FIGS. 8 and 9 illustrate advantageous features of the previously-disclosed invention. For example, in FIG. 18 the flow is into a sudden enlargement. This illustrates the flow pattern at the inlet to the doctor blade chamber or at other abrupt changes and flow area. The flow of velocity over the "shadowed" surfaces is typically insufficient to clean away the ink solids.

In FIG. 8 these shadowed areas are designated 42 and 43 and it will be seen that the velocity of flow is relatively low as indicated by the arrows 44 and 45 in contrast to the arrows 46 along the axis of the conduit 47.

This is solved by the operation designated in FIG. 9 which shows a flow in a sudden contraction. When the flow is reversed from that seen in FIG. 8, the previously shadowed areas are now subjected to very high velocities as at 48 and 49 which high velocities carry the ink solids away.

Several variations on the above sequence and variations on solvent supply/return are possible depending upon preference for operation. Of distinct advantage, however, are the closed circuit pumping to allow high solvent rates without leaking past the end seals, and multiple reversal of flow direction to eliminate "shadowed" circuits on the inside of the doctor blade chamber.

ALTERNATIVE EMBODIMENT

An alternative embodiment provides a system without the solvent saver receiver and associated conduits and valve.

After inking is performed as seen in FIG. 2, the alternative embodiment performs, as the next step, that illustrated in FIG. 5 where the system is charged with fresh solvent. Thereafter, the washing step of FIG. 4 is performed. Following that, there are two drain steps—here illustrated in FIGS. 6A and 7A. These differ essentially from FIGS. 6 and 7 in not using the solvent saver receiver 131 but instead in using the waste receiver 130, previously described in connection with FIG. 5.

CHAMBER AND SUPPLY LINE DRAIN WITHOUT SOLVENT SAVER

Figure 6A:
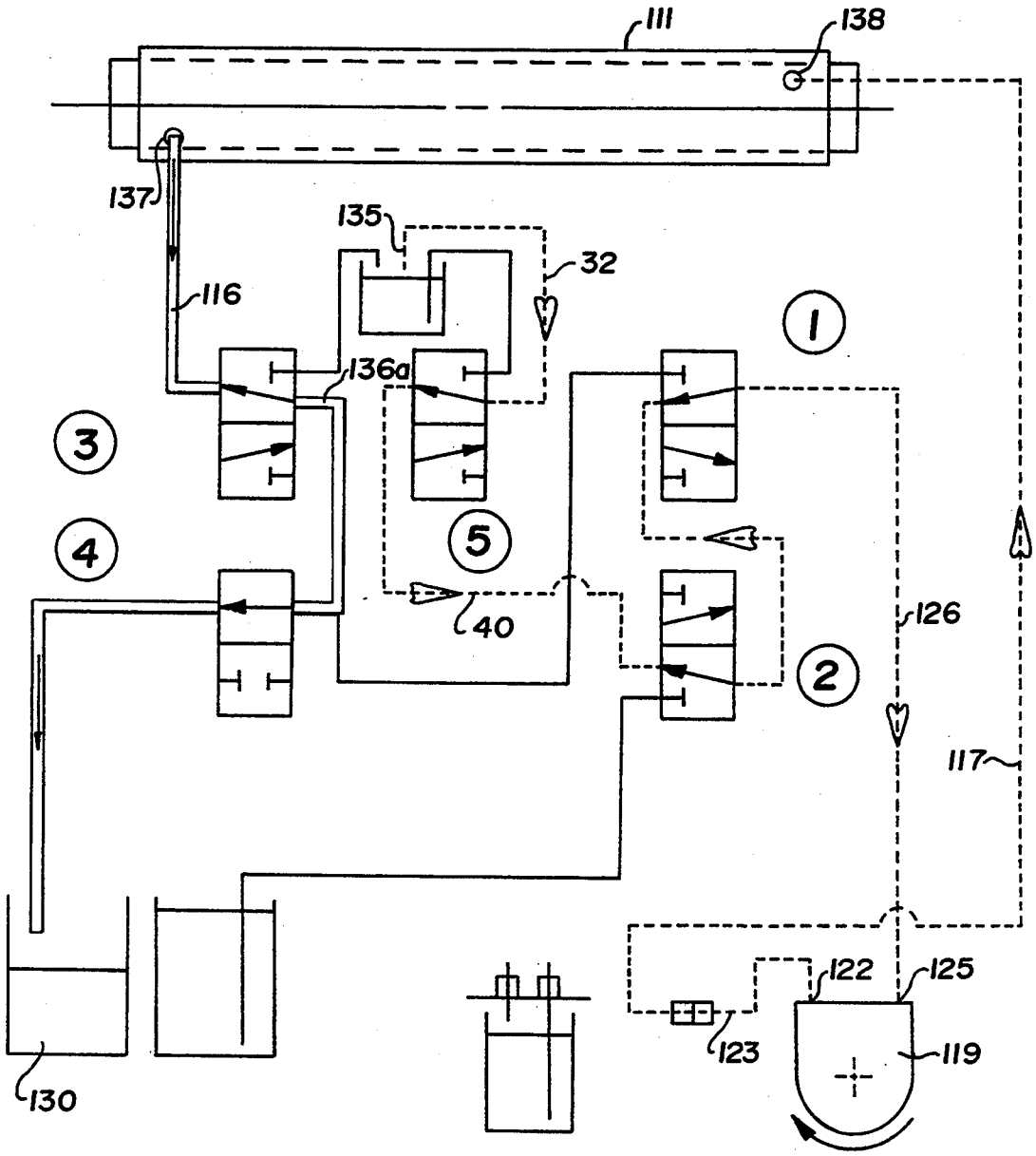
FIG. 6A is a schematic view similar to FIG. 6 being of a chamber and supply line drain to waste, i.e., without having the solvent saver present.

In FIG. 6A, it is seen generally that after the last wash cycle is complete, the balls in valves 1 and 4 are shifted and the pump 119 is run in reverse—as designated by the clockwise directed arrow and opposite to the showing in FIG. 2 for inking. This draws air into the system from air vent 135 and expels the solvent in the system into the waste receiver 130. The air flow is indicated by dotted lines.

More particularly, valve 5 is connected via conduit 32 to the air vent 135 and as in FIG. 6 is connected to port 125 of pump 119. The output of pump 119 (in this orientation) is through port 122, lines 123 and 117 into the upper port 138 of the chamber 111. Ink flows out of the chamber 111 via port 137 into a conduit 116, valve 2, conduit 136*a*, conduit 128*a*, valve 4 and conduit 128 into the waste receiver 130.

RETURN LINE AND PUMP DRAIN

Figure 7A:
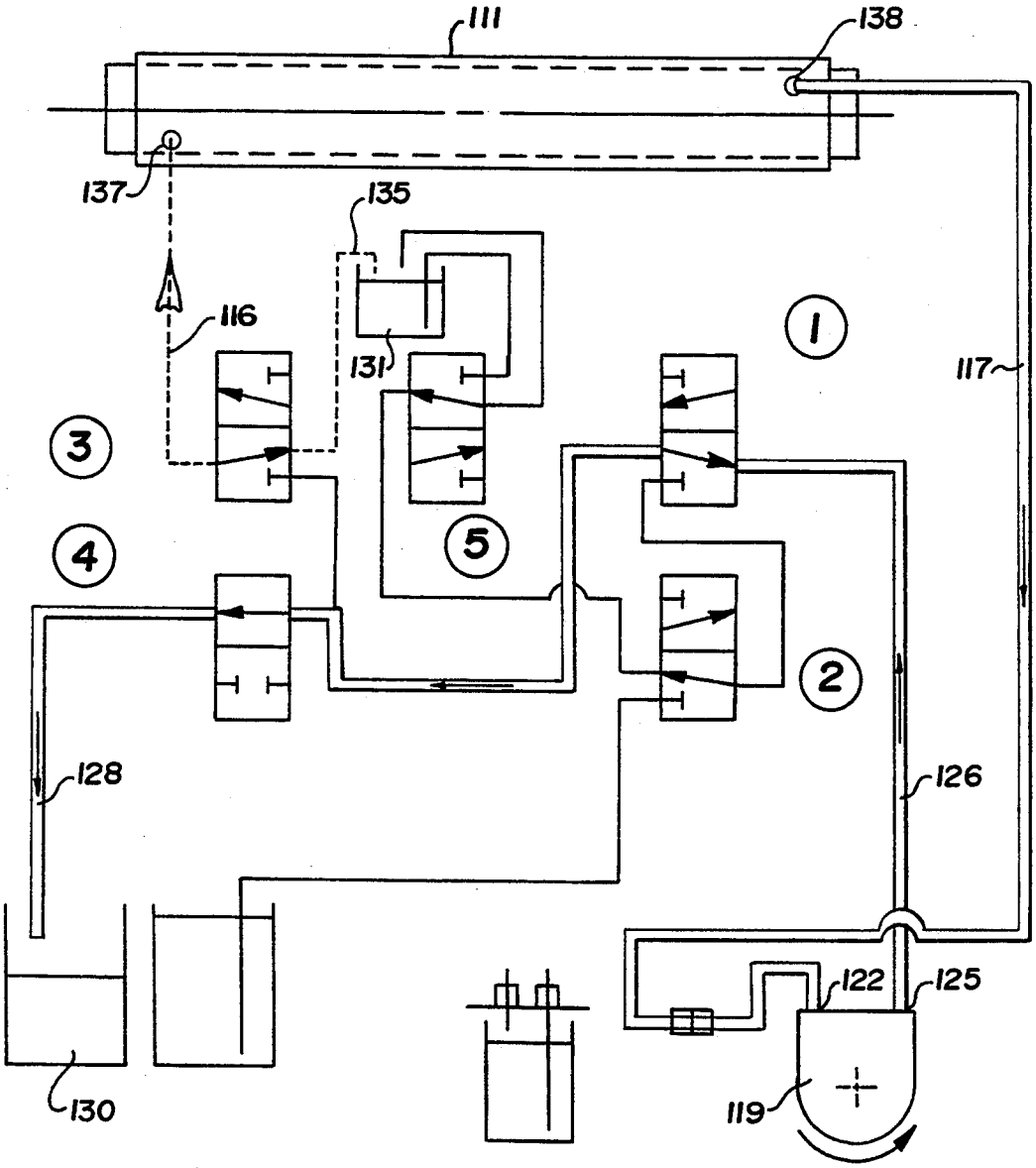
FIG. 7A is a schematic view similar to FIG. 7 but of return line and pump drain to waste and without using the solvent save receiver.

This is illustrated in connection with FIG. 7A which is almost identical to FIG. 7 but with the exception that the waste liquid after leaving valve 1 goes to the waste receiver 130 rather than the receiver 131.

Air is drawn into the system at 135 (upper left center), flows through conduit 133 through valve 3 and line 116 into port 137 of chamber 111. After flushing solvent out of the fountain 111, the air (now mixed with solvent) exits through port 138 and line 117 to the port 122 of pump 119. The mixture leaves through pump port 124, line 126 and valves 1 and 4 to conduit 128 and into receiver 130.

SUMMARY

In summary, the apparatus for washing the deck of a flexographic press as seen in FIG. 1 includes a frame F which rotatably supports an anilox roll 10. The roll 10 closes part of a relatively elongated ink chamber mounted on the frame F. The chamber has doctor blades 12, 13 and end seals as at 14 in contact with the anilox roll 10 to define a closed chamber. The chamber 11 has a pair of spaced apart ports 37, 38 adjacent the end seals in said chamber for introducing and removing fluid after the fluid has flowed through said chamber—see FIG. 2.

As seen in FIG. 1, a reversible pump 19 is operably associated with the frame F and an ink source 20, a solvent source 29 or 31, and a waste receiver 30 are also operably associated with the frame F.

The invention also includes conduits, i.e., fluid carrying pipes or hoses which connect the pump 19 with the ink source 20 as at 23—see FIG. 1. The pump 19 is also connected with the solvent source 29 as at 27, the solvent saver source 31 as at 32, the waste receiver 30 as at 28 and the fountain ports 37, 38 as at 16, 17—see also FIG. 3. As part of the hydraulic system, we provide a plurality of valves 1–5 which are interconnected in the conduits for a series of functions.

A first function is to direct ink from the ink source 20 through the chamber 11 in a first condition of the valves. This is illustrated in FIG. 2 where the ink enters the pump 19 at port 22 from the ink pail 20 and conduit 23. The ink is pumped out of the pump 19 into lower port 37 of the chamber or fountain 11, through the fountain, out of upper port 38 via line 17 back to the ink pail 20.

A second function is for directing solvent from the solvent source which may be the once used solvent reservoir 31 of FIG. 3 or the fresh solvent source 29 of FIG. 5 through the ink chamber in a second condition of the valves and while the pump 19 is disconnected from the ink source 20.

A third function is to circulate solvent through the ink chamber by setting the valves in a third condition while the pump 19 is disconnected from the ink source 20 and both can be seen in FIG. 4 where a controller 19*a* on the pump 19 operates to reverse the pump direction a plurality of times to alternately introduce the solvent into one port 37, 38 and thereafter into the other port 38, 37. As can be appreciated from a consideration of FIG. 4, the hydraulic system generally designated S is now in the condition of a closed loop—no fluid being taken in or discharged.

A concluding step in the general operation or condition of the valve means 1–5 is directing the recycled solvent from the third function described above into the waste receiver 130 when the solvent saver is not employed. This is seen in FIGS. 6A and 7A where the exiting used solvent is replaced by air. This readies the system for charging with new ink.

However, the preferred way of practicing the invention involves conserving the once used solvent for reuse—after a different inking has occurred.

In this embodiment, the solvent source used initially is that of the reservoir 31 which contains "once used" solvent. By once used, we refer to the fact that fresh solvent has been sent through the system after a previous flushing with solvent provided in the reservoir 31 from a previous ink run. Generally, the once used solvent is sent in a closed loop in the system orientation of FIG. 4 to provide "twice used" solvent (once for each of two different inks) which is then drained to the waste receiver 30. The fresh solvent is directed from the fresh solvent source 29 through the ink chamber 11 to force the previous solvent into the waste receiver 30—as in FIG. 5. Thereafter, the new solvent replaces the twice used solvent and is drained into the reservoir 31. This is done first as seen in FIG. 6 and thereafter as seen in FIG. 7. At this point the system (except for the reservoir 31) is generally free of solvent, containing only air.

While in the foregoing specification an embodiment of the invention has been set down for the purpose of illustration, many variations in the details hereingiven may be made without departing from the spirit and scope of the invention.

We claim:

1. Apparatus for washing the deck of a flexographic press comprising a frame rotatably supporting an anilox roll, a relatively elongated ink chamber mounted on the frame and having doctor blades and end seals in contact with said anilox roll to define a closed chamber, a pair of spaced apart fountain ports adjacent said end seals in said chamber for introducing and removing fluid after said fluid has flowed through said chamber, a reversible pump operably associated with said frame, an ink source, a solvent source, and a waste receiver also operably associated with said frame, conduit means connecting said pump with said ink source, said solvent source, said waste receiver and with said fountain ports, and valve means operably associated with said conduit means for (a) directing ink from said ink source through said chamber in a first condition of said valve means, (b) directing solvent from said solvent source through said ink chamber in a second condition of said valve means and while said pump is disconnected from said ink source, (c) circulating solvent through said ink chamber in a third condition of said valve means and while said pump is disconnected from both said ink source and said solvent source, means operably associated with said pump for reversing the direction of flow therein during said third condition to alternately introduce solvent into one port and thereafter into the other port, and (d), directing solvent from (c) into said waste receiver in a fourth condition of said valve means.

2. The apparatus of claim 1 in which said solvent source is a once used solvent receiver and said frame has operably associated therewith a fresh solvent source, said valve means in condition (b) directing once used solvent from said once used solvent receiver through said ink chamber, circulating said once used solvent in condition (c), and directing fresh solvent from said fresh solvent source through said ink chamber to replace said once used solvent and into said once used solvent receiver.

3. The apparatus of claim 1 in which said solvent source is a fresh solvent source.

4. The apparatus of claim 1 in which said valve means are operable to introduce air into one port of said ink chamber in one rotational condition of said pump and to introduce air into the other port of said ink chamber in a reverse rotational condition of said pump.

5. The apparatus of claim 1 in which said means operably associated with said pump is operative to reverse said pump direction a plurality of times during said third condition.

6. A system for washing the deck of a flexographic press comprising a frame rotatably supporting an anilox roll, a relatively elongated ink chamber mounted on the frame and having doctor blades and end seals in contact with said anilox roll to define a closed chamber, a pair of spaced apart fountain ports adjacent said end seals in said chamber for introducing and removing fluid after said fluid has flowed through said chamber, a reversible pump means operably associated with said frame, an ink source, a fresh solvent source, a once-used solvent reservoir, a waste receiver, and an air port means also operably associated with said frame, conduit means connecting said pump means with all of said ink source, said fresh solvent source, said once-used solvent reservoir, said waster receiver, said air vent means and said fountain ports, and valve means operably associated with said conduit means for (a) directing ink from said ink source through said ink chamber in a first condition of said valve means, (b) directing once used solvent from said reservoir through said ink chamber in a second condition of said valve means and while said pump is disconnected from said ink source and said fresh solvent source and for directing ink remaining in said system to said waste receiver, (c) circulating said once used solvent through said ink chamber while said pump is disconnected from all of said ink source, fresh solvent source, once used solvent reservoir, and said waste receiver in a third condition of said value means, means being operably associated with said pump for reversing the direction of flow therein and reversing the pump direction a plurality of times during said third condition to alternately introduce solvent into one port and thereafter into the other port to convert said once used solvent into waste solvent, (d) directing fresh solvent from said fresh solvent source through said ink chamber in a fourth condition of said valve means to convert said fresh solvent into further once used solvent while directing said waste solvent into said waste receiver, and (e) directing said further once used solvent into said once used solvent reservoir in a fifth condition of said valve means while introducing air through said air port means.

7. The system of claim 6 in which said conduit means includes a first conduit portion connecting a first of said ports with said once-used solvent reservoir, said conduit means including a second conduit portion connecting a second of said ports with said once-used solvent receiver, said valve means being operative to direct a first portion of said once-used solvent through said first conduit portion and thereafter directing a second portion of said once-used solvent through said second conduit portion.

8. The system of claim 6 in which said air port means is operably associated with said once used solvent reservoir.

9. Apparatus for washing the deck of a flexographic press comprising a frame rotatably supporting an anilox roll, a relatively elongated ink chamber mounted on the frame and having doctor blades and end seals in contact with said anilox roll to define a closed chamber, a pair of spaced apart fountain ports adjacent said end seals in said chamber for introducing and removing fluid after said fluid has flowed through said chamber, a reversible pump means operably associated with said frame, an ink source, a solvent source, a waste receiver and air port means also operably associated with said frame, conduit means connecting said pump means with said ink source, said solvent source, said waste receiver and with said fountain ports, and valve means operably associated with said conduit means for (a) directing ink from said ink source through said ink chamber in a first condition of said valve means, (b) directing solvent from said solvent source through said ink chamber in a second condition of said valve means and while said pump is disconnected from said ink source, (c) circulating solvent through said ink chamber in a third condition of said valve means and while said pump is disconnected from both said ink source and said solvent source, means operably associated with said pump for reversing the direction of flow therein and reversing the pump direction during said third condition to alternately introduce solvent into one port and thereafter into the other port to convert said fresh solvent into waste solvent, and (d) directing waste solvent into the waste receiver in a fourth condition of said valve means while introducing air into said conduit means.

10. A method for washing the deck of a flexographic press comprising the steps of providing a system including a closed, relatively elongated ink chamber having a port at each end, an ink source, a solvent source, a used solvent receiver, a reversible pump and conduit means coupling said ink chamber, ink source, pump, solvent source and used solvent receiver, circulating ink to said ink chamber from said ink source for a predetermined time and after discontinuance of said ink circulating, introducing solvent from said solvent source into said ink chamber, pump and conduit means, disconnecting said pump from said solvent source while providing a closed loop for solvent between said pump and said ink chamber ports, circulating solvent in said closed loop while reversing the pump to alternate the flow direction of the solvent through said ink chamber, and thereafter removing solvent from said ink chamber to said used solvent receiver.

11. The method of claim 10 in which the rate of flow during alternated pumping is up to about five times greater than the rate of ink circulation.

12. The method of claim 10 in which said providing step also includes providing a once used solvent reservoir, said introducing step including introducing once used solvent from said reservoir, said pumping step including pumping said once used solvent in said closed loop, and said removing step includes draining the once used solvent from the system while introducing fresh solvent as replacement for the drained solvent.

13. The method of claim 12 in which said steps include simultaneously introducing air into said system while directing the replacement solvent to said system.

14. The method of claim 13 in which said air introducing step includes introducing air into one port of said ink chamber in one rotational condition of said pump and introducing air into the other port of said ink chamber in the reverse rotational condition of said pump.

15. The method of claim 10 in which said introducing step includes introducing fresh solvent from said solvent source and said removing step includes removing circulated solvent while introducing air into said ink chamber.

* * * * *